US008107858B2

(12) United States Patent
Okabe

(10) Patent No.: US 8,107,858 B2
(45) Date of Patent: Jan. 31, 2012

(54) DISCHARGER AND PROCESS CARTRIDGE

(75) Inventor: Yasushi Okabe, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 316 days.

(21) Appl. No.: 12/408,123

(22) Filed: Mar. 20, 2009

(65) Prior Publication Data

US 2009/0324286 A1 Dec. 31, 2009

(30) Foreign Application Priority Data

Jun. 25, 2008 (JP) ..... 2008-165966

(51) Int. Cl.
*G03G 21/00* (2006.01)
*G03G 21/06* (2006.01)
*G03G 21/08* (2006.01)

(52) U.S. Cl. ..... 399/128

(58) Field of Classification Search ..... 399/128; 250/216; 428/354
See application file for complete search history.

(56) References Cited

U.S. PATENT DOCUMENTS

2002/0081126 A1* 6/2002 Yokomori et al. ..... 399/118
2002/0172530 A1* 11/2002 Kido et al. ..... 399/128
2004/0001169 A1* 1/2004 Saiki et al. ..... 349/96
2004/0076768 A1* 4/2004 Kamiya et al. ..... 428/1.1
2005/0074606 A1* 4/2005 Nishiyama et al. ..... 428/354
2006/0060751 A1* 3/2006 Nishimura et al. ..... 250/208.1
2009/0097880 A1* 4/2009 Kawahara et al. ..... 399/128

FOREIGN PATENT DOCUMENTS

JP 62-127786 6/1987

* cited by examiner

*Primary Examiner* — David Gray
*Assistant Examiner* — David Bolduc
(74) *Attorney, Agent, or Firm* — Banner & Witcoff, Ltd.

(57) ABSTRACT

A discharger is provided, which can eliminate charge from a surface of a photoconductor. The discharger includes: a light source; a light guide member; a cover which covers the light guide member to expose at least an opposed surface of the light guide member to the photoconductor; and an adhesive tape which uses nonwoven fabric as a substrate, which is disposed between the light guide member and the cover so that the opposed surface of the light guide member is disposed between the tape and the photoconductor, and which bonds the light guide member and the cover to each other.

7 Claims, 4 Drawing Sheets

U
D
F
B
R
L
A
7
20A
20B
20C
20D
20E
20F
21
21A
21B
21C
21D
22
22A
23
24
10

DISCHARGER AND PROCESS CARTRIDGE

CROSS REFERENCE TO RELATED APPLICATION

The present disclosure relates to the subject matter contained in Japanese patent application No. 2008-165966 filed on Jun. 25, 2008, which is expressly incorporated herein by reference in its entirety.

TECHNICAL FIELD

The present invention relates to an image forming apparatus and, in particular, to a discharger which can eliminate remaining charge from a photoconductor. The present invention also relates to a process cartridge.

BACKGROUND ART

An electrophotographic image forming apparatus including a photoconductor is known. In this apparatus, an electrostatic latent image is formed on a surface of a charged photoconductor, the latent image is developed into a developer image by developer, and the developer image is transferred onto a recording medium to form an image on the medium. After the developer image is transferred onto the recording medium, a discharger eliminates remaining charge from the surface of the photoconductor as preparation for next image formation.

Patent Document 1 discloses an photoelectric discharger as an example of the discharger. The photoelectric discharger includes an optical fiber extending in a direction of a central axis of the photoconductor to face an outer peripheral surface of a photoconductive drum, and a lamp, i.e. a light source, disposed alongside the photoconductive drum in the central axis direction.

The optical fiber has a core, i.e. a bar-like transparent glass, a clad, i.e. a cylindrical transparent glass or the like covering the core, and a reflecting tape attached to the outer periphery of the clad. The outer peripheral surface of the core has a diffusion surface formed as a consequence of fine irregularity processing.

The photoelectric discharger operates as follows: Light emitted from the lamp enters the optical fiber, and is reflected by the reflecting tape toward the diffusion surface. The light is diffused by the diffusion surface to enter the core, and then irradiated onto the outer peripheral surface of the photoconductive drum while being reflected by the boundary between the core and the clad. Accordingly, the outer peripheral surface of the photoconductive drum is exposed, and charges remaining on the outer peripheral surface of the photoconductive drum are eliminated therefrom.

Patent Document 1: Japanese Published Unexamined Patent Application No. S62-127786

The photoelectric discharger disclosed in Patent Document 1 is complicated in configuration because the number of components (core, clad, and reflecting tape, etc.) of the optical fiber is large and the diffusion surface must be formed on the core by applying irregularity processing.

SUMMARY

The present invention was made in view of the above-noted and other circumstances.

As one of illustrative, non-limiting embodiment, the present invention can provide a discharger which can eliminate charge from a surface of a photoconductor. The discharger includes: a light source; a light guide member; a cover; and a double coated adhesive tape. The cover covers the light guide member to expose at least an opposed surface of the light guide member to the photoconductor. The adhesive tape bonds the light guide member and the cover to each other and uses nonwoven fabric as a substrate.

As another one of illustrative, non-limiting embodiment, the present invention can provide a process cartridge to be installed in an image forming apparatus. The process cartridge includes: a photoconductor; a light guide member; a cover; and a double coated adhesive tape. The cover covers the light guide member to expose at least an opposed surface of the light guide member to the photoconductor. The adhesive tape bonds the light guide member and the cover to each other and uses nonwoven fabric as a substrate.

Accordingly, as an advantage, the present invention can provide a discharger of a simple configuration. As another advantage, the present invention can provide a discharger which can eliminate charge from a surface of a photoconductor effectively. As yet another advantage, the present invention can provide a featured process cartridge.

These and other advantages will be discussed in detail with reference to the accompanying drawings.

DESCRIPTION OF THE PREFERRED EMBODIMENT

Hereinafter, a process cartridge 1, which is an exemplary embodiment according to the present invention, will be described with reference to the drawings.

<Outline of Process Cartridge>

Figure 1:
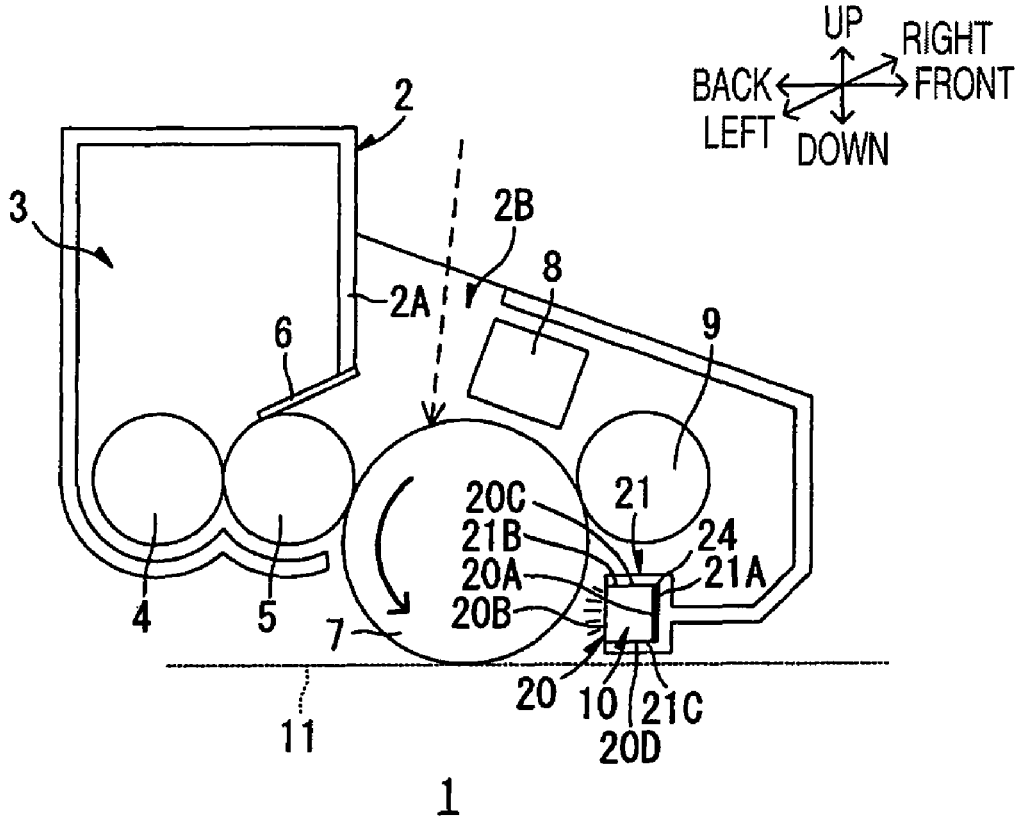
FIG. 1 is a schematic left side sectional view showing a process cartridge according to an exemplary embodiment of the present invention.

FIG. 1 is a schematic left side sectional view showing the process cartridge 1. In FIG. 1, arrows (direction arrows) indicating up, down, front, back, left, and right are shown, and the arrows are referred to for identifying a direction (the same applies to the drawings subsequent to FIG. 1). Here, the front side in the drawing paper thickness direction in FIG. 1 is the left side, and the back side in the drawing paper thickness direction in FIG. 1 is the right side. The right-left direction and the width direction are the same. The horizontal direction includes the front-back direction and the right-left direction. These directions are used to explain the structure of the process cartridge 1 and to facilitate the understanding of the structure, and therefore should not be interpreted in a restrictive sense.

The process cartridge 1 is installed in a casing (image forming apparatus casing) of an electrophotographic image forming apparatus (not shown) such as a laser printer and functions as an essential portion for image formation.

The process cartridge 1 includes a housing 2, a developer accommodation chamber 3, a supply roller 4, a developing roller 5, a layer thickness restricting blade 6, a photoconductive drum 7 as an example of a photoconductor, a charger 8, a cleaning roller 9, and a discharger 10.

The housing 2 has a hollow box shape, and inside the housing 2, the developer accommodation chamber 3, the supply roller 4, the developing roller 5, the layer thickness restricting blade 6, the photoconductive drum 7, the charger 8, the cleaning roller 9, and the discharger 10 are disposed.

The developer accommodation chamber 3 is a space partitioned on the back side inside the housing 2. The developer accommodation chamber 3 accommodates therein, for example, positively-charged nonmagnetic single-component toner as an example of developer.

The supply roller 4 is supported rotatably by the housing 2 so that the central axis thereof extends in the width direction at the lower end of the developer accommodation chamber 3. Accordingly, the toner in the developer accommodation chamber 3 is always accumulated on the outer peripheral surface of the supply roller 4 due to its own weight.

The developing roller 5 is supported rotatably by the housing 2 so that the central axis thereof extends in the width direction. The developing roller 5 is disposed at a front side of the supply roller 4, and is pressure-contacted with the supply roller 4.

The layer thickness restricting blade 6 is an elastic member extending from a wall 2A (partitioning the developer accommodation chamber 3 in the housing 2) backward and downward toward the developing roller 5, and a tip end (lower end) thereof is pressure-contacted with the upper side outer peripheral surface of the developing roller 5.

The photoconductive drum 7 has a cylindrical shape, and is supported rotatably by the housing 2 so that the central axis thereof extends in the width direction. The photoconductive drum 7 is disposed at a front side of the developing roller 5, and is pressure-contacted with the developing roller 5. The photoconductive drum 7 rotates counterclockwise in FIG. 1 (see the illustrated thick arrow). The outer peripheral surface of the lower side of the photoconductive drum 7 is exposed downward from the housing 2. The outer peripheral surface of the photoconductive drum 7 (outermost layer) is formed of a positively-chargeable photoconductive layer made of, for example, polycarbonate. An upper wall of the housing 2 above the photoconductive drum 7 has a communicating hole 2B, through which the inside and the outside of the housing 2 communicate with each other.

The charger 8 is, for example, a scorotron type charger, and is supported by the housing 2 to be located above the photoconductive drum 7. The charger 8 is opposed to the outer peripheral surface of the photoconductive drum 7 with a distance.

A cleaning roller 9 is supported rotatably by the housing 2 so that its central axis extends in the width direction. The cleaning roller 9 is located at a front side of the photoconductive drum 7 to be pressure-contacted with the photoconductive drum 7. The outer peripheral surface of the cleaning roller 9 is coated with, for example, a conductive foam material. To the cleaning roller 9, a cleaning bias is applied.

The discharger 10 is supported by the housing 2. The discharger 10 is disposed at a front side of the photoconductive drum 7 and below the cleaning roller 9 to be opposed to the outer peripheral surface of the photoconductive drum 7 with a distance. The discharger 10 will be described in detail later.

During image formation, toner accumulated on the supply roller 4 in the developer accommodation chamber 3 enters between the tip end of the layer thickness restricting blade 6 and the developing roller 5 as the supply roller 4 and the developing roller 5 rotate, to form a thin toner layer carried on the outer peripheral surface of the developing roller 5.

The outer peripheral surface of the photoconductive drum 7 is positively charged uniformly across the width direction by the charger 8, and then exposed to a laser beam (see the dashed-line arrow in FIG. 1) irradiated via the communicating hole 2B of the housing 2 from the image forming apparatus casing side (not shown). Accordingly, an electrostatic latent image based on image data is formed on the outer peripheral surface of the photoconductive drum 7.

As the photoconductive drum 7 and the developing roller 5 rotate, the toner carried on the outer peripheral surface of the developing roller 5 is supplied to the electrostatic latent image on the outer peripheral surface of the photoconductive drum 7. Accordingly, the electrostatic latent image is developed (visualized) as a toner image carried on the outer peripheral surface of the photoconductive drum 7.

As the photoconductive drum 7 further rotates, the toner image is exposed downward from the housing 2, where the toner image is transferred onto a recording medium 11. The toner image transferred onto the recording medium 11 is heat-fixed. This way, image formation is completed.

Here, toner may remain on the outer peripheral surface of the photoconductive drum 7 after the toner image is transferred onto the recording medium 11 from the photoconductive drum 7 (this toner is referred to as residual transfer toner, when applicable). In this case, during rotation of the photoconductive drum 7, the residual transfer toner is transferred onto the outer peripheral surface of the cleaning roller 9 by the above-described cleaning bias and captured by the cleaning roller 9. When image formation is finished, a bias opposite to the cleaning bias is applied to the cleaning roller 8, and accordingly, the residual transfer toner captured by the cleaning roller 9 is discharged to the photoconductive drum 7 from the cleaning roller 9 and then collected by the developing roller 5.

<Details of Discharger>

Next, the discharger 10 will be described in detail.

Figures 2A, 2B, 2C:
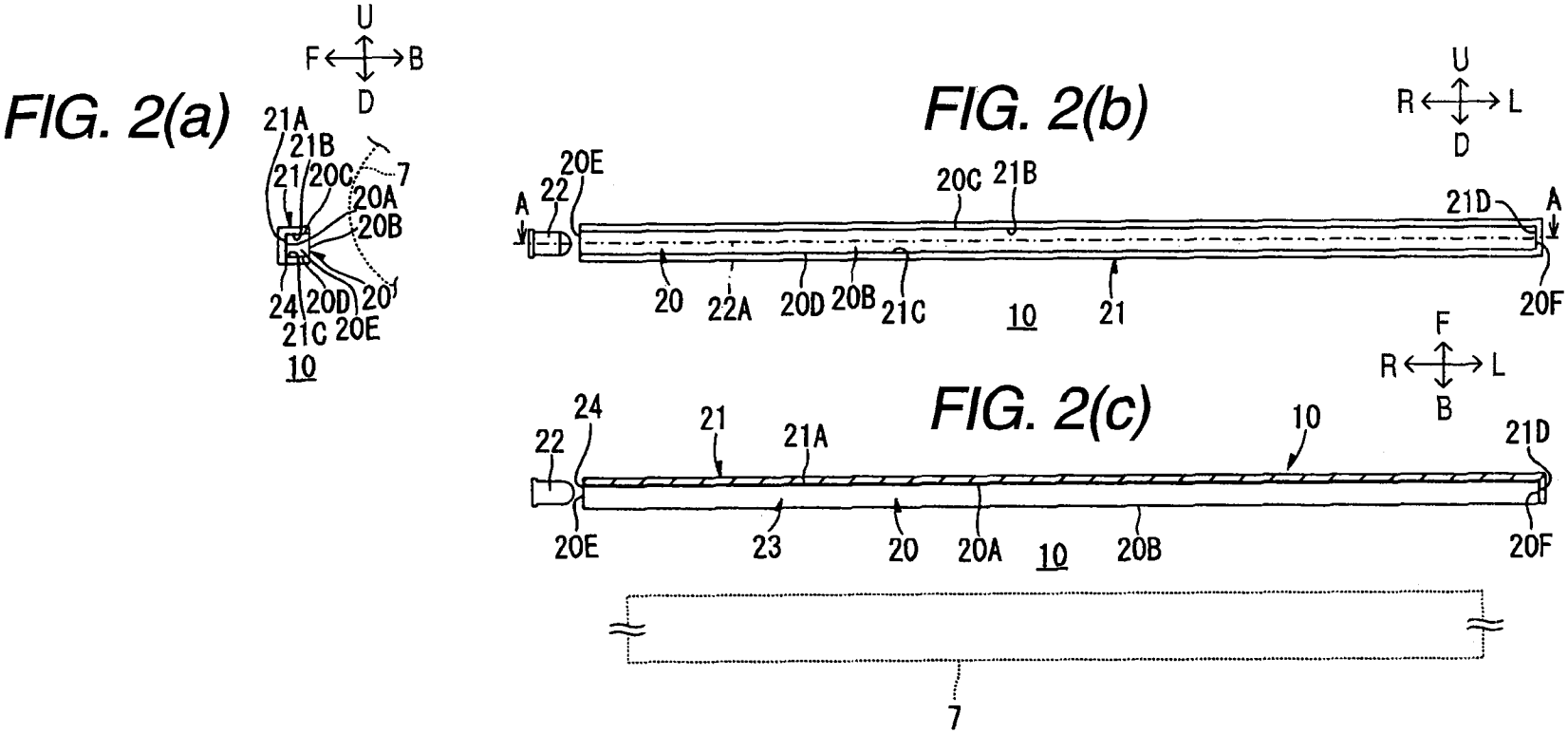
FIG. 2(*a*) is a right side view of a discharger, FIG. 2(*b*) is a back view of the discharger, and FIG. 2(*c*) is a sectional view along the arrow A-A of FIG. 2(*b*).
Figure 3:
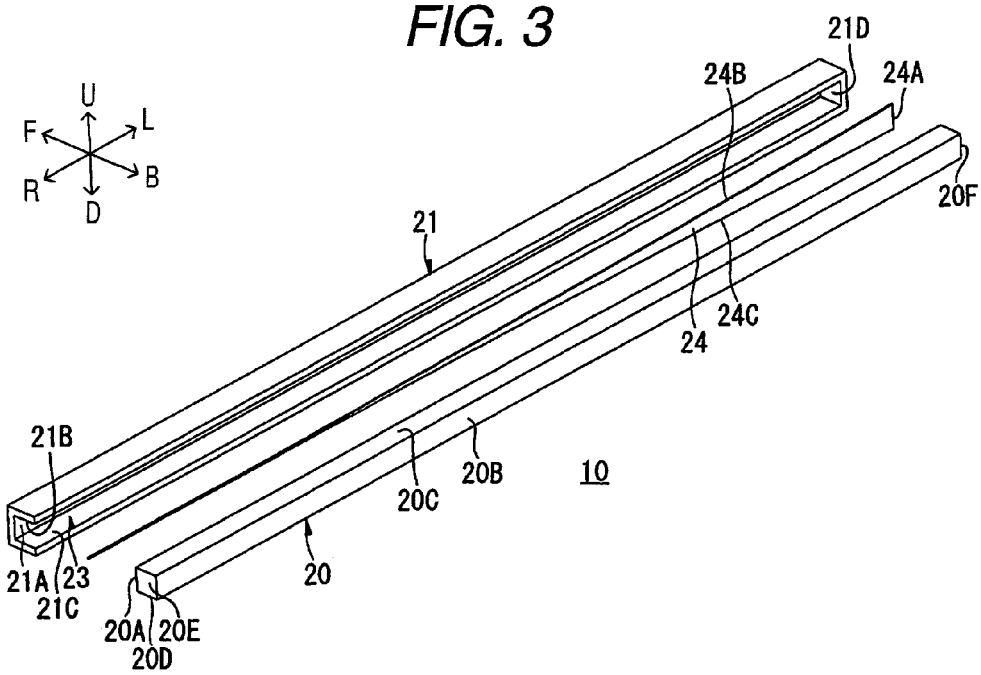
FIG. 3 is an exploded perspective view of the discharger from the back side.
Figure 4A:
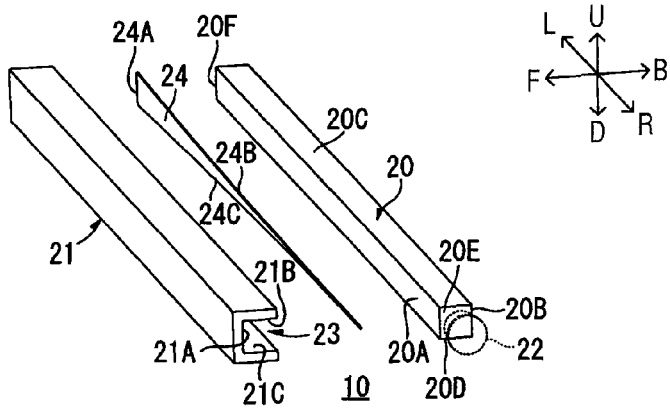
FIGS. 4(*a*) and 4(*b*) are exploded perspective views of the discharger from the front side.
Figure 4B:
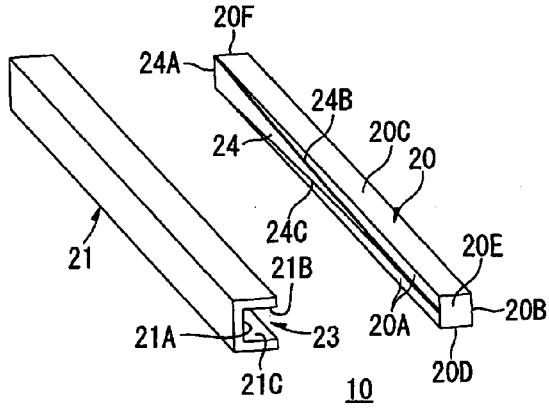

FIG. 2(*a*) is a right side view of the discharger, FIG. 2(*b*) is a back view of the discharger, and FIG. 2(*c*) is a sectional view along the arrow A-A of FIG. 2(*b*). FIG. 3 is a perspective view showing the discharger from the back side. FIGS. 4(*a*) and 4(*b*) are perspective views of the discharger from the front side. In FIG. 2(*a*) and FIG. 2(*c*), for reference, the photoconductive drum 7 is shown by a dotted line.

Here, after the toner image is transferred, charge remains on the outer peripheral surface of the photoconductive drum 7. The remaining charge must be completely eliminated from the outer peripheral surface of the photoconductive drum 7 before the outer peripheral surface of the photoconductive drum 7 is charged for next image formation, in order that the outer peripheral surface of the photoconductive drum 7 can be charged uniformly across the width direction as described above (the potential on the outer peripheral surface after charging becomes uniform across the width direction). Therefore, each time the transfer of the toner image onto the recording medium 11 from the photoconductive drum 7 is complete, the discharger 10 eliminates remaining charges from the outer peripheral surface of the photoconductive drum 7 for next image formation.

As shown in FIG. 2(*c*), the discharger 10 includes a light guide member 20, a cover 21, a double coated adhesive tape 24 and a light source 22.

As shown in FIG. 3, the light guide member 20 is, for example, a transparent bar made of acrylic resin, and is long in the width direction. As shown in FIG. 2(*c*), the light guide member 20 is disposed at a front side of the photoconductive drum 7 to be opposed to the outer peripheral surface of the photoconductive drum 7 with a distance. The right end of the light guide member 20 is located outside the right end of the photoconductive drum 7, and the left end of the light guide member 20 is located outside the left end of the photoconductive drum 7. In other words, the light guide member 20 extends along the central axis of the photoconductive drum 7, and is opposed to the entire region, in the width direction, of the outer peripheral surface of the photoconductive drum 7. As shown in FIG. 2(*a*), the shape (right side sectional shape) of the light guide member 20 as viewed in the width direction is a square shape while the four sides extend along either the up-down or front-back direction, so that the light guide member 20 is a quadrangular prism long in the width direction (see also FIG. 3). In other words, as shown in FIGS. 3, 4(*a*) and 4(*b*), the light guide member 20 is defined by the front surface 20A and the back surface 20B having rectangular shapes extending in the up-down and right-left directions, the upper surface 20C and the lower surface 20D having rectangular shapes extending in the front-back and right-left directions, and the right surface 20E and the left surface 20F having rectangular shapes extending in the up-down and front-back directions. In the light guide member 20, the back surface 20B is opposed to the outer peripheral surface of the photoconductive drum 7 from the front side with a predetermined distance (see FIG. 2(*c*)). The back surface 20B serves as an example of an opposed surface.

The cover 21 has a shape slightly larger than and analogous to the shape of the light guide member 20, and in detail, the cover 21 is a quadrangular prism long in the width direction similar to the light guide member 20, but is hollow unlike the light guide member 20. Unlike the light guide member 20, the cover 21 is not transparent and does not transmit light. As shown in FIG. 3, the back surface and the right surface of the cover 21 are continuously notched (opened), and accordingly, the inner space 23 of the cover 21 is exposed via the back surface and the right surface of the cover 21. In other words, the right side sectional shape of the cover 21 is a substantially U-shape whose back side is opened. The inner space 23 of the cover 21 has a size just capable of housing the light guide member 20. Here, the inner space 23 of the cover 21 is defined by inner surfaces of the cover 21, i.e. a front inner surface 21A at the front side, an upper inner surface 21B at the upper side, a lower inner surface 21C at the lower side and a left inner surface 21D at the left side. As described above, the back surface and the right surface of the cover 21 are continuously notched, and therefore no surfaces define the inner space 23 at the back and right sides.

The front inner surface 21A has the same size as that of the front surface 20A of the light guide member 20, and extends parallel to the front surface 20A. The upper inner surface 21B has the same size as that of the upper surface 20C of the light guide member 20, and extends parallel to the upper surface 20C. The lower inner surface 21C has the same size as that of the lower surface 20D of the light guide member 20, and extends parallel to the lower surface 20D. The left inner surface 21D has the same size as that of the left surface 20F of the light guide member 20, and extends parallel to the left surface 20F.

The front inner surface 21A, the upper inner surface 21B, the lower inner surface 21C and the left inner surface 21D are, for example, painted with white or plated so as to satisfactorily reflect (diffuse) light. The cover 21 itself may be made of a white resin.

As shown in FIG. 1, the front surface of the cover 21 is connected to the housing 2 so that the discharger 10 (excluding the light source 22) is supported by the housing 2 and forms a part of the process cartridge 1. In detail, the cover 21 is formed as a part of the housing 2 integrally with the housing 2.

As shown in FIG. 2(*c*), the light guide member 20 is accommodated in the inner space 23 of the cover 21. In this case, the front surface 20A of the light guide member 20 is disposed at the back side of the front inner surface 21A of the cover 21 to be opposed thereto, the upper surface 20C of the light guide member 20 is disposed at the lower side of the upper inner surface 21B of the cover 21 to be opposed thereto, the lower surface 20D of the light guide member 20 is disposed at the upper side of the lower inner surface 21C of the cover 21 to be opposed thereto, and the left surface 20F of the light guide member 20 is disposed at the right side of the left inner surface 21D of the cover 21 to be opposed thereto (see FIGS. 2(*b*) and 3). In addition, as shown in FIGS. 2(*a*) and 2(*b*), the back surface 20B of the light guide member 20 is exposed to the back side from the notched back surface of the cover 21, and the right surface 20E of the light guide member 20 is exposed to the right side from the notched right surface of the cover 21.

As shown in FIG. 3, the double coated adhesive tape 24 is interposed between the front surface 20A of the light guide member 20 and the front inner surface 21A of the cover 21. The double coated adhesive tape 24 is formed by using nonwoven fabric as a substrate and impregnating this nonwoven fabric with an adhesive component. Therefore, the double coated adhesive tape 24 has adhesion at any portion. The nonwoven fabric forms fine irregularities on the surfaces of the double coated adhesive tape 24.

The double coated adhesive tape 24 has a uniform thin thickness in the front-back direction and has an isosceles triangular shape which is long in the right-left direction and gradually becomes wider in the up-down direction as it approaches from the right side to the left side. In detail, this double coated adhesive tape 24 has an isosceles triangular shape which has a first side 24A extending in the up-down direction at the left end, and two sides (second side 24B and third side 24C) extending toward the right side from the upper end and the lower end of the first side 24A, respectively, so as to approach each other. The second side 24B and the third side 24C have lengths equal to each other. The right end of the second side 24B and the right end of the third side 24C are connected to each other to form the right end of the double coated adhesive tape 24. The size, in the right-left direction, of the double coated adhesive tape 24 is substantially equal to the size, in the right-left direction, of the front surface 20A of the light guide member 20 and the size in the right-left direction of the front inner surface 21A of the cover 21. The size of the first side 24A of the double coated adhesive tape 24 is substantially equal to the size, in the up-down direction, of the front surface 20A of the light guide member 20 and the size, in the up-down direction, of the front inner surface 21A of the cover 21. The double coated adhesive tape 24 may have a triangular shape other than the isosceles triangular shape.

As shown in FIG. 4(*a*), the double coated adhesive tape 24 is disposed between the front surface 20A of the light guide member 20 and the front inner surface 21A of the cover 21 first when the light guide member 20 is accommodated in the inner space 23 of the cover 21.

Next, as shown in FIG. 4(*b*), the back surface of the double coated adhesive tape 24 is stuck on the front surface 20A of the light guide member 20 from the front side so that the first side 24A (left end) of the double coated adhesive tape 24 matches the left side (left end) of the front surface 20A of the light guide member 20 and the right end of the double coated adhesive tape 24 matches the right side (right end) of the front surface 20A of the light guide member 20. In detail, the right end of the double coated adhesive tape 24 matches the center, in the up-down direction, of the right side of the front surface 20A of the light guide member 20.

The light guide member 20 on which the double coated adhesive tape 24 is stuck is accommodated in the inner space 23 of the cover 21, and the front surface of the double coated adhesive tape 24 is stuck on the front inner surface 21A of the cover 21 from the back side (see also FIG. 3), so that the first side 24A (left end) of the double coated adhesive tape 24 matches the left side (left end) of the front inner surface 21A of the cover 21 and the right end of the double coated adhesive tape 24 matches the right side (right end) of the front inner surface 21A of the cover 21. In detail, the right end of the double coated adhesive tape 24 matches the center, in the up-down direction, of the right side of the front inner surface 21A of the cover 21. Accordingly, the light guide member 20 and the cover 21 are bonded to each other and integrated together by the double coated adhesive tape 24. In this state, the cover 21 covers the light guide member 20 so that at least the back surface 20B opposed to the photoconductive drum 7 of the light guide member 20 is exposed to the back side toward the photoconductive drum 7. The double coated adhesive tape 24 is disposed between the front surface 20A, positioned at the front side of the back surface 20B of the light guide member 20, and the front inner surface 21A of the cover 21. Accordingly, the double coated adhesive tape 24 is disposed at the opposite side from the photoconductive drum 7 with respect to the back surface 20B of the light guide member 20.

The light source 22 is disposed at the right side of the light guide member 20 as shown in FIG. 2(*b*) and FIG. 2(*c*), and is supported by the image forming apparatus casing side (not shown) described above. The light source 22 is disposed at the right side of the right surface 20E of the light guide member 20 to be opposed thereto with a distance (see also FIG. 4(*a*)). As described above, the light guide member 20 is long in the width direction, and is disposed at the front side of the photoconductive drum 7 to be opposed to the outer peripheral surface of the photoconductive drum 7. The light source 22 is disposed at the right side of the light guide member 20, in particular, alongside the photoconductive drum 7 in the central axis direction (width direction) of the photoconductive drum 7 in the image forming apparatus casing (not shown). The light source is supported by the image forming apparatus casing side (not shown) described above. In this state, the light source 22 can emit light to the left side along the width direction. In other words, as shown in FIG. 2(*b*), the optical axis 22A of the light source 22 (optical axis direction) extends in the width direction, and is parallel to the central axis of the photoconductive drum 7 (see FIG. 2(*c*)).

Here, the above-described double coated adhesive tape 24 gradually widens in the up-down direction as it approaches from the right side to the left side (see FIG. 3). Accordingly, the adhesive surface (back surface) of the double coated adhesive tape 24 to the light guide member 20 gradually widens in the direction (up-down direction) orthogonal to the optical axis direction (width direction) of the light source 22 as distance from the light source 22 toward the left side is larger.

The discharger 10 thus configured is actuated after the toner image is transferred from the photoconductive drum 7 onto the recording medium 11 as described above.

In detail, referring to FIG. 2(*c*), after transfer of the toner image, the light source 22 emits light, and light from the light source 22 travels to the left side along the width direction. This light is made incident on the right surface 20E of the light guide member 20 to enter into the light guide member 20, and continuously travels to the left side along the width direction inside the light guide member 20. Since the cover 21 covers the light guide member 20 to expose at least the back surface 20B to the photoconductive drum 7 at the back side as described above, a part of light incident traveling to the left side inside the light guide member 20 naturally leaks to the back side from the back surface 20B of the light guide member 20. The light which thus naturally leaks to the back side includes light which is reflected by the inner surfaces of the cover 21 (the front inner surface 21A, the upper inner surface 21B, the lower inner surface 21C, and the left inner surface 21D) during traveling and travels to the back side from the back surface 20B.

Light nearly reaching the double coated adhesive tape 24 of the light traveling to the left side inside the light guide member 20 strikes the back surface of the double coated adhesive tape 24 (in detail, irregularities on the back surface of the double coated adhesive tape 24 which are formed by non-woven fabric forming the double coated adhesive tape 24) and diffuses, and accordingly, its traveling direction is changed to the back side. Accordingly, this light travels to the back side through the back surface 20B exposed to the photoconductive drum 7 at the back side of the light guide member 20.

The light thus naturally leaking to the back side from the back surface 20B during traveling and the light which is diffused by the adhesive tape 24 and travels to the back side are combined and continuously travel to the back side, and are irradiated onto the outer peripheral surface of the photoconductive drum 7. By irradiating light from the light guide member 20 onto the outer peripheral surface of the photoconductive drum 7, the irradiated portion of the photoconductive drum 7 is exposed, and therefore charge remaining on this portion is eliminated.

Here, the more distant from the light source 22, the harder it is for the light from the light source 22 to reach. Therefore, it is harder for the light incident into the inside of the light guide member 20 to reach the region more distant from the light source 22 and closer to the left end of the light guide member 20. Accordingly, the amount of light naturally leaking to the back side from the back surface 20B of the light guide member 20 during traveling may become smaller as the light travels more distant from the light source 22 toward the left end of the light guide member 20. In this case, the amount of light (irradiation amount) irradiated from the light guide member 20 onto the photoconductive drum 7 may become smaller at a position more distant from the light source 22 and closer to the left end of the light guide member 20.

The double coated adhesive tape 24 as describe above can function to prevent the irradiation amount from becoming smaller at a position more distance from the light source 22. In detail, as described above, the double coated adhesive tape 24 gradually widens in the up-down direction as it approaches from the right side to the left side (see FIG. 3 and FIGS. 4(*a*) and 4(*b*)), and therefore the double coated adhesive tape 24 can diffuse, to the back side, larger part of the light traveling inside the light guide member 20 as it is farther from the light source 22 and closer to the left side (left surface 20F) of the light guide member 20. Therefore, even if the amount of light naturally leaking to the back side from the back surface 20B of the light guide member 20 during traveling becomes smaller toward the left side away from the light source 22, the amount of light which is diffused by the double coated adhesive tape 24 at positions away from the light source 22 increases instead.

Accordingly, even if the light travels toward the left side away from the light source 22, the total of the amount of light naturally leaking to the back side from the back surface 20B during traveling and the amount of light diffused by the double coated adhesive tape 24 to the back side can be made substantially constant, and therefore the irradiation amount of light onto the photoconductive drum 7 from the light guide member 20 becomes substantially uniform across the width direction. Accordingly, with this discharger 10, charge remaining on the outer peripheral surface of the photoconductive drum 7 can be eliminated uniformly in the width direction.

The light guide member 20 is configured to guide the light from the light source 22 and to irradiate the light onto the entire region, in the width direction, of the photoconductive drum 7. Then, in this state, by rotating the photoconductive drum 7 after transferring the toner image, light from the light guide member 20 is irradiated onto the entire region, in the circumferential direction, of the photoconductive drum 7. Accordingly, finally, charge remaining on the outer peripheral surface of the photoconductive drum 7 is eliminated uniformly.

<Operation and Effect>

(1) As described above, the process cartridge 1 has the light guide member 20 opposed to the outer peripheral surface of the photoconductive drum 7, and the light source 22 is disposed alongside the photoconductive drum 7 in the central axis direction (width direction). Light from the light source 22 is irradiated onto the photoconductive drum 7 across the central axis direction while being guided by the light guide member 20 along the central axis direction of the photoconductive drum 7. Accordingly, the outer peripheral surface of the photoconductive drum 7 is exposed, and charge on the outer peripheral surface of the photoconductive drum 7 can be eliminated therefrom across the central axis direction.

The cover 21 covers the light guide member 20 so that at least the back surface 20B of the light guide member 20 is exposed to the photoconductive drum 7 (see FIG. 2(*a*) and FIG. 2(*b*)). Accordingly, the light guide member 20 can concentrate the light from the light source 22 on the back surface 20B and irradiate the light onto the photoconductive drum 7 from the back surface 20B without leakage. Accordingly, charge on the outer peripheral surface of the photoconductive drum 7 can be effectively eliminated.

By bonding the light guide member 20 and the cover 21 to each other by the double coated adhesive tape 24, the light guide member 20 and the cover 21 can be easily integrated.

This double coated adhesive tape 24 uses nonwoven fabric as a substrate to form fine irregularities on the surface thereof. The double coated adhesive tape 24 is disposed at the opposite side from the photoconductive drum 7 with respect to the back surface 20B of the light guide member 20. Accordingly, the light guided by the light guide member 20 strikes the irregularities on the surface of the double coated adhesive tape 24 and diffuses, and accordingly, its traveling direction is changed toward the back surface 20B, and the light is positively irradiated onto the photoconductive drum 7.

In other words, with the simple configuration in which the light guide member 20 and the cover 21 are bonded to each other by the double coated adhesive tape 24 using nonwoven fabric as a substrate, even without applying processing for forming irregularities on the light guide member 20 and the cover 21, the light guided by the light guide member 20 can be diffused by the irregularities on the surfaces of the double coated adhesive tape 24 and positively irradiated onto the photoconductive drum 7, and charge on the outer peripheral surface of the photoconductive drum 7 can be effectively eliminated.

(2) The adhesive surface (back surface) of the double coated adhesive tape 24 to the light guide member 20 becomes wider in the up-down direction orthogonal to the optical axis direction (width direction) of the light source 22 as it is farther from the light source 22 (see FIG. 3 and FIGS. 4(*a*) and 4(*b*)). In other words, with the simple configuration in which the adhesive surface of the double coated adhesive tape 24 is merely made wider as it is farther from the light source 22, the double coated adhesive tape 24 reliably diffuses the light even at a position distant from the light source 22 and light hardly sufficiently reaches. A sufficient irradiation amount of light onto the photoconductive drum 7 can be secured. Accordingly, the light irradiation amount onto the photoconductive drum 7 from the light guide member 20 can be restrained from becoming smaller as it is farther from the light source 22 along the central axis direction of the photoconductive drum 7. Therefore, the light guide member 20 can uniformly irradiate the light from the light source 22 onto the entire region, in the central axis direction, of the photoconductive drum 7. Consequently, charge on the outer peripheral surface of the photoconductive drum 7 can be eliminated therefrom uniformly across the central axis direction.

<Exemplary Variation>

Figure 5A:
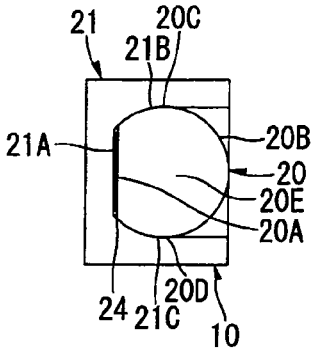
FIGS. 5(*a*) and 5(*b*) are views showing an exemplary variation applied to a light guide member shown in FIG. 2(*a*).
Figure 5B:
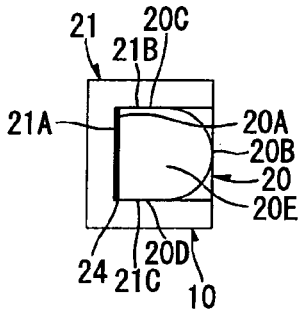
Figure 5B:
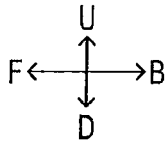
Figure 6A:
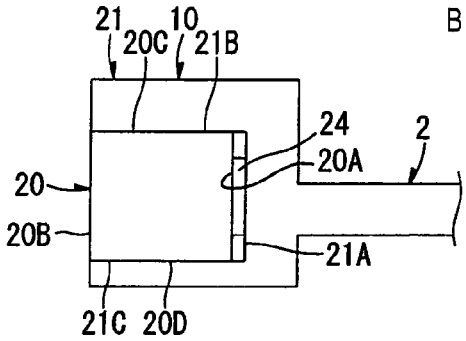
FIG. 6(*a*) is a enlarged view showing a part of FIG. 1, and FIGS. 6(*b*) and 6(*c*) are enlarged views showing exemplary variations applied to the portion of FIG. 1.
Figure 6A:
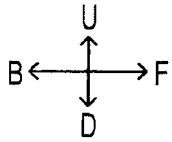
Figure 6B:
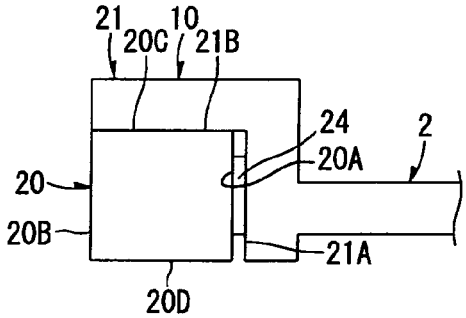
Figure 6C:
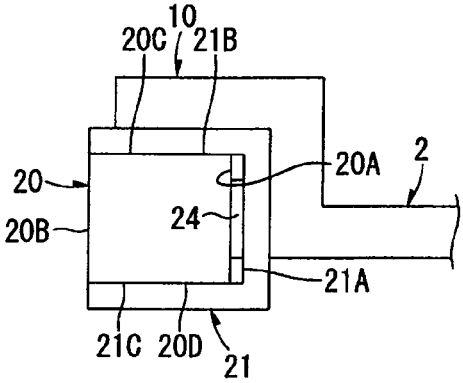

FIGS. 5(*a*) and (5)*b* showing exemplary variations applied to the light guide member 20 shown in FIG. 2(*a*). FIG. 6(*a*) is an enlarged view showing a portion of FIG. 1, and FIGS. 6(*b*) and 6(*c*) are enlarged views showing another exemplary variations applied to the portion of FIG. 1.

In the above-described embodiment, as shown in FIG. 2(*a*), the shape of the light guide member 20 viewed in the width direction (right side sectional shape) is a substantially square shape four sides of which extend in either the up-down or front-back direction. In other words, the light guide member 20 of the above-described embodiment has flat surfaces, i.e. the front surface 20A, the back surface 20B, the upper surface 20C and the lower surface 20D, extending in either the up-down or front-back direction.

Here, the right side sectional shape of the light guide member 20 may not be a square shape, but may be, for example, a rectangular shape long in the front-back direction. In other words, the light guide member 20 may have a flat-plate shape.

Further, as shown in FIGS. 5(*a*) and 5(*b*), the back surface 20B, the upper surface 20C, and/or the lower surface 20D may be curved as viewed in the width direction.

In detail, as shown in FIG. 5(*a*), the front surface 20A is still flat, however, the back surface 20B, the upper surface 20C, and the lower surface 20D continue while smoothly curving, and form an arc shape swelling to the back side integrally. As shown in FIG. 5(*b*), the front surface 20A, the upper surface 20C, and the lower surface 20D are still flat, however, only the back surface 20B has an arc shape swelling to the back side. In other words, the light guide member 20, to which each of the variations shown in FIG. 5 is applied, includes the arc curved back surface 20B swelling to the back side and functioning as a lens. Accordingly, can be collectively irradiated from the light guide member 20 onto the photoconductive drum 7 without being diffused radially. Accordingly, charge on the outer peripheral surface of the photoconductive drum 7 can be more effectively eliminated therefrom.

In the embodiment described above, the cover 21 covers the light guide member 20 so that only the back surface 20B and right surface 20E are exposed (see FIGS. 2(*a*), 2(*b*) and 2(*c*)), and the cover 21 is formed as a part of the housing 2 integrally with the housing 2 (see FIG. 1 and FIG. 6(*a*)).

Alternatively, the cover 21 may cover the light guide member 20 to expose, for example, the lower surface 20D as well as the back surface 20B and the right surface 20E, as shown in FIG. 6(*b*).

Further, the cover 21 may be configured separately from the housing 2 as shown in FIG. 6(*c*).

In the embodiment described above, a laser printer configured to form an electrostatic latent image by exposing the photoconductive drum 7 by a laser is illustrated, however, the present invention is applicable to all electrophotographic image forming apparatuses which perform image formation by forming an electrostatic latent image on a charged photoconductive drum or a charged photoconductive belt.

As discussed above, the present invention can provide at least the following illustrative, non-limiting embodiments:

(1) A discharger configured to eliminate charge from an outer peripheral surface of a photoconductor, the discharger including: a light source disposed alongside the photoconductor in a central axis direction thereof; a light guide member which is opposed to the surface of the photoconductor, and which is configured to guide light from the light source so as to irradiate the light onto the photoconductor across the central axis direction; a cover which covers the light guide member so that at least an opposed surface of the light guide member is opposed and exposed to the photoconductor; and a double coated adhesive tape which uses nonwoven fabric as a substrate, and which is disposed at an opposite side from the photoconductor with respect to the opposed surface, and which bonds the light guide member and the cover to each other.

(2) The discharger according to (1), wherein the adhesive surface of the double coated adhesive tape to the light guide member become wider in a direction orthogonal to the optical axis direction of the light source as the adhesive tape is farther from the light source.

(3) The discharger according to (1) or (2), wherein the opposed surface is a curved surface.

(4) A process cartridge to be installed in an image forming apparatus casing, the process cartridge including: a photoconductor; a light guide member which is opposed to an outer peripheral surface of the photoconductor, and which is configured to guide light from a light source disposed alongside the photoconductor in a central axis direction thereof in the image forming apparatus casing so as to irradiate the light onto the photoconductor across the central axis direction; a cover which covers the light guide member so that at least an opposed surface of the light guide member is opposed and exposed to the photoconductor; and a double coated adhesive tape which uses nonwoven fabric as a substrate, and which is disposed at an opposite side from the photoconductor with respect to the opposed surface, and which bonds the light guide member and the cover to each other.

(5) The process cartridge according to (4), wherein the adhesive surface of the double coated adhesive tape to the light guide member become wider in a direction orthogonal to the optical axis direction of the light source as the adhesive tape is farther from the light source.

(6) The process cartridge according to (4) or (5), wherein the opposed surface is a curved surface.

According to the discharger of (1) and the cartridge of (4), the light guide member is opposed to the outer peripheral surface of the photoconductor, and the light source is disposed alongside the photoconductor in the central axis direction. Light from the light source is irradiated onto the photoconductor across the central axis direction while being guided in the central axis direction by the light guide member. Accordingly, the outer peripheral surface of the photoconductor is exposed, and charge on the outer peripheral surface of the photoconductor is eliminated across the central axis direction.

The cover covers the light guide member so that at least an opposed surface of the light guide member is opposed and exposed to the photoconductor. Accordingly, the light guide member can concentrate the light from the light source on the opposed surface and irradiate the light onto the photoconductor from the opposed surface without leakage. Accordingly, charge on the outer peripheral surface of the photoconductor can be effectively eliminated.

The light guide member and the cover and bonded to each other by the double coated adhesive tape. Accordingly, the light guide member and the cover can be easily integrated.

The double coated adhesive tape uses nonwoven fabric as a substrate, so that on the surfaces thereof, fine irregularities are formed, and the double coated adhesive tape is disposed at the opposite side from the photoconductor with respect to the opposed surface of the light guide member. Accordingly, the light guided by the light guide member strikes the irregularities on the surface of the double coated adhesive tape and diffuses, and accordingly, its traveling direction is changed toward the opposed surface, and the light is positively irradiated onto the photoconductor.

In other words, with the simple configuration in which the light guide member and the cover are bonded to each other by the double coated adhesive tape which uses nonwoven fabric as a substrate, even without applying processing for forming irregularities on the light guide member and the cover, the light guided by the light guide member can be diffused by the irregularities on the surface of the double coated adhesive tape and positively irradiated onto the photoconductor, and charge on the outer peripheral surface of the photoconductor can be effectively eliminated.

According to the discharger of (2) and the cartridge of (5), the adhesive surface of the double coated adhesive tape to the light guide member become wider in a direction orthogonal to the optical axis direction of the light source as the adhesive surface is farther from the light source. In other words, with the simple configuration in which the adhesive surface of the double coated adhesive tape is simply made wider as the adhesive surface is farther from the light source, the double coated adhesive tape can reliably diffuse the light reaching from the light source even at a position distant from the light source and light hardly sufficiently reaches. Consequently, a sufficient irradiation amount of light onto the photoconductor can be secured. Accordingly, the light irradiation amount onto the photoconductor from the light guide member can be restrained from becoming smaller as it is farther from the light source along the central axis direction of the photoconductor. Therefore, the light guide member can uniformly irradiate the light from the light source onto the entire region, in the central axis direction, of the photoconductor. Accordingly, charge on the outer peripheral surface of the photoconductor can be eliminated therefrom uniformly across the central axis direction.

According to the discharger of (3) and the cartridge of (6), the opposed surface of the light guide member to the photoconductor is a curved surface. Accordingly, the opposed surface can function as a lens, and intensively irradiates light from the light guide member onto the photoconductor without diffusing it. Accordingly, charge on the outer peripheral surface of the photoconductor can be more effectively eliminated.

What is claimed is:

1. A discharger configured to eliminate charge from a surface of a photoconductor, the discharger comprising:

a light source;

a light guide member which extends in a first direction to be opposed to the surface of the photoconductor, and which is configured to guide light from the light source to the photoconductor;

a cover which covers the light guide member to expose at least an opposed surface of the light guide member to the photoconductor; and a double coated adhesive tape which bonds the light guide member and the cover to each other, and which has non woven fabric as a substrate, the tape extending in an axial direction of the photoconductor and being disposed on a surface of the light guide member that is opposed to the opposed surface.

2. The discharger according to claim 1, wherein adhesive surfaces of the double coated adhesive tape become wider in a direction orthogonal to the first direction as the double coated adhesive tape extends farther from the light source in the first direction.

3. The discharger according to claim 1, wherein the opposed surface is curved.

4. A process cartridge to be installed in an image forming apparatus, the process cartridge comprising:

a photoconductor;

a light guide member which extends in a first direction to be opposed to a surface of the photoconductor, and which is configured to guide light from a light source to photoconductor;

a cover which covers the light guide member to expose at least an opposed surface of the light guide member to the photoconductor; and a double coated adhesive tape which bonds the light guide member and the cover to each other, and which has non woven fabric as a substrate, the tape extending in an axial direction of the photoconductor and being disposed on a surface of the light guide member that is opposed to the opposed surface.

5. The process cartridge according to claim 4, wherein adhesive surfaces of the double coated adhesive tape become wider in a direction orthogonal to the first direction as the double coated adhesive tape extends farther from the light source in the first direction.

6. The process cartridge according to claim 4, wherein the opposed surface is curved.

7. A process cartridge to be installed in an image forming apparatus, the process cartridge comprising:

a housing;

a photoconductive drum supported by the housing to be rotatable about an axis; and a light guide member supported by the housing to extend in a direction of the axis, wherein the light guide member includes:

an incidence surface;

an incidence opposed surface opposed to the incidence surface in the direction of the axis;

a first surface extending in the direction of the axis, connected to the incidence surface and incidence opposed surface and being opposed to the photoconductive drum;

a second surface opposed to the first surface and located so that the first surface is disposed between the second surface and the photoconductive drum;

a third surface connected to the first surface and the second surface;

a fourth surface connected to the first surface and the second surface and opposed to the third surface; and a nonwoven fabric substrate attached to the second surface and configured to diffuse light, propagating from the incidence surface, toward the first surface, and extending in the direction of the axis of the photoconductive drum.

* * * * *